US006149733A

United States Patent [19]

Djumlija et al.

[11] Patent Number: 6,149,733

[45] Date of Patent: Nov. 21, 2000

[54] APPARATUS AND METHOD FOR DESCALING A WORKPIECE WITH A LIQUID JET

[75] Inventors: Gerlinde Djumlija, Vöcklabruck; Karl Kremmaier, Ottensheim; Johann Oberhumer, Unterweitersdorf; Andreas Schweighofer, Leonding; Herwig Wrulich, Zeltweg, all of Austria

[73] Assignee: Voest-Alpine Industrianlagenbau GmbH, Linz, Austria

[21] Appl. No.: 09/117,618

[22] PCT Filed: Jan. 29, 1997

[86] PCT No.: PCT/AT97/00015

§ 371 Date: Oct. 5, 1998

§ 102(e) Date: Oct. 5, 1998

[87] PCT Pub. No.: WO97/27955

PCT Pub. Date: Aug. 7, 1997

[30] Foreign Application Priority Data

Feb. 2, 1996 [AT] Austria ..... 195/96

[51] Int. Cl.[7] ..... B08B 1/04; B08B 3/02

[52] U.S. Cl. ..... 134/32; 134/34; 134/172; 239/251; 239/264

[58] Field of Search ..... 134/32, 34, 172, 134/176, 179; 239/251, 269

[56] References Cited

U.S. PATENT DOCUMENTS

| | | | |
|---|---|---|---|
| 3,883,075 | 5/1975 | Edney | 239/101 |
| 4,151,808 | 5/1979 | Beck et al. | 118/2 |
| 5,220,935 | 6/1993 | Bailey et al. | 134/102.1 |

FOREIGN PATENT DOCUMENTS

| | | |
|---|---|---|
| 0586823 | 3/1994 | European Pat. Off. . |
| 2335893 | 1/1975 | Germany . |
| 4328303 | 6/1994 | Germany . |

*Primary Examiner*—Randy Gulakowski
*Assistant Examiner*—Saeed T. Chaudhry
*Attorney, Agent, or Firm*—Ostrolenk, Faber, Gerb & Soffen, LLP

[57] ABSTRACT

A workpiece is moved past a rotor descaling device, which intermittently sprays the workpiece with at least one liquid jet formed intermittently in dependence on angular positions of a rotor rotating on a rotational axis intersecting the surface (23) of the workpiece (22).

10 Claims, 2 Drawing Sheets

APPARATUS AND METHOD FOR DESCALING A WORKPIECE WITH A LIQUID JET

BACKGROUND OF THE INVENTION

The invention relates to a process for descaling a workpiece, particularly a rolled piece, wherein the workpiece is moved past a rotor descaling device, where at least one liquid jet rotating on a rotational axis intersecting the workpiece surface to be descaled is sprayed onto the surface to be descaled, with the liquid jet being formed intermittently, i.e. with temporary interruptions, with the liquid jet being formed intermittently, i.e. with temporary interruptions, and to a rotor descaling device for implementing the process.

DISCUSSION OF RELATED ART

Rotor descaling devices are known, for example, from DE-A-43 28 303 or EP-A-0586 823 or DE-A-31 25 146. These known rotor descaling devices are equipped with spray nozzles which are located at rotating beams or rotating nozzle holders and directed towards the workpiece surface to be descaled. As a rule, the rotational axis is perpendicular to the workpiece surface to be descaled.

In this process, liquid admission patterns are formed by individual spray curves in the form of intertwined cycloids according to the relative motion between the workpiece and the rotating spray nozzles, which is dependent on the movement of the workpiece and the nozzle speed, as well as according to the number of nozzles. As a result, liquid jets are repeatedly admitted to one and the same workpiece surface. The disadvantage of this process is that the consumption of sprayed liquid is very high and, thus, the workpiece cools to a lower temperature than actually required for descaling.

A process for spraying the liquid jets onto the workpiece surface at an inclination against the moving direction of the workpiece is known from EP-A-0 640 413. According to this document, this process is implemented by covering the liquid jet over that part of its rotational motion which does no longer meet the requirement of being directed against the moving direction of the workpiece. This process also involves high liquid consumption even though no the total amount of liquid strikes the workpiece.

Rotor descaling devices of the aforementioned type are already known from U.S. Pat. No. 5,220,935 and DE-A 23 55 893, according to which liquid consumption can be reduced by applying an intermittent liquid jet. Furthermore, double admission of liquid jets onto workpiece surfaces and, thus, unnecessary undercooling of the rolled piece, particularly with a view to a subsequent rolling process, is avoided.

However, this embodiment does not yet allow optimum descaling of a workpiece at minimum liquid consumption.

A special effect of the process according to the invention is that pressure peaks occur which are caused by single or repeated interruption of the liquid jet and lead to elevated jet pressures. As a result, the descaling effect is essentially improved. The pressures of the liquid jets assume peak values amounting to a multiple of the constant jet pressures known from conventional processes. According to the invention, the impact pressures of the liquid jets on the surface of the workpiece are so high that the liquid pressure can be considerably lowered and an improved descaling effect is achieved.

SUMMARY OF THE INVENTION

The object of the invention is to avoid the described disadvantages and difficulties and to develop a process and a device for implementing the process where the effect of elevated jet pressures resulting from intermittent formation of the liquid jet is enhanced and distributed over the surface of the workpiece. Furthermore, optimum descaling at minimum liquid consumption is to be achieved. Particularly, not only a reduction of liquid consumption but also of the liquid pressure is to be achieved without any deterioration of the quality of the surfaces to be descaled.

According to the invention, this problem is solved by interrupting the formation of liquid jet twice or several times in succession, however, only for a short period of time, i.e. maximally over a liquid jet rotation of 10°, preferably 5°.

In this process, the liquid jets are expediently simultaneously formed.

A rotor descaling device for implementing the process according to the invention with a liquid supply line to a stator and a rotor which is pivoted compared with the stator and equipped with at least one nozzle for the formation of a liquid jet is characterized in that an interrupting device is provided between the rotor and stator which allows intermittent liquid supply to a nozzle.

The interrupting device is expediently comprised of a stationary plate cam which is rigidly fixed compared with the stator and provided with at least one control port to allow liquid passage to the nozzle which is limited in time.

A preferred embodiment is characterized in that the liquid supply line leads into a liquid chamber located at the rotor, the rotor is provided with a port through which the liquid is conveyed to the nozzle, one mouth of the port leads into the liquid chamber, and the port can be intermittently closed by means of the plate cam and is cleared when the mouth of the port is in congruent position with the control port.

A solution providing for a simple design is characterized in that a plurality of ports is provided and that each port leads to one nozzle each of the rotor, at least two mouths of the ports leading into the liquid chamber at different radial distances from the rotational axis of the rotor and the plate cam being provided with a control port corresponding to a mouth of a port and allowing liquid passage from the liquid chamber to the port.

Several control ports are expediently provided at identical radial distances from the rotational axis of the rotor, the control ports located at identical radial distances from the rotational axis of the rotor being advantageously combined in groups.

If a liquid jet is to be maintained over a slightly longer distance, i.e. not only in specific points, one control port is designed as a control slot extending in circumferential direction of the plate cam according to a preferred embodiment.

It is particularly advantageous to design the nozzles as circular-section jet nozzles because higher jet pressures compared with flat-jet nozzles can be achieved thereby since the jet is only minimally widened at circular-section jet nozzles.

BRIEF DESCRIPTION OF THE DRAWINGS

The invention is explained in greater detail by several embodiments shown in the following drawing, where FIG. 1 schematically represents a section through a rotor descaling device, this section being passed through the rotational axis.

DETAILED DESCRIPTION OF THE PREFERRED EMBODIMENTS

Figure 1:
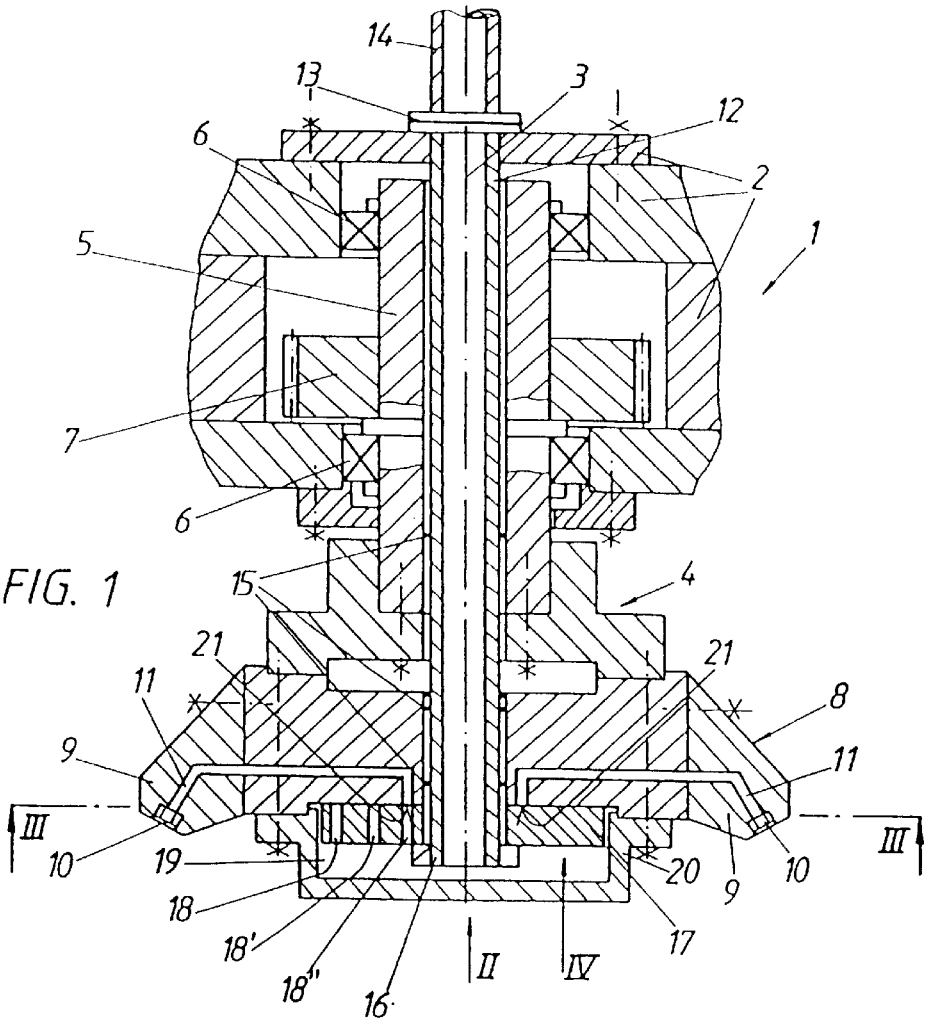
Figure 2:
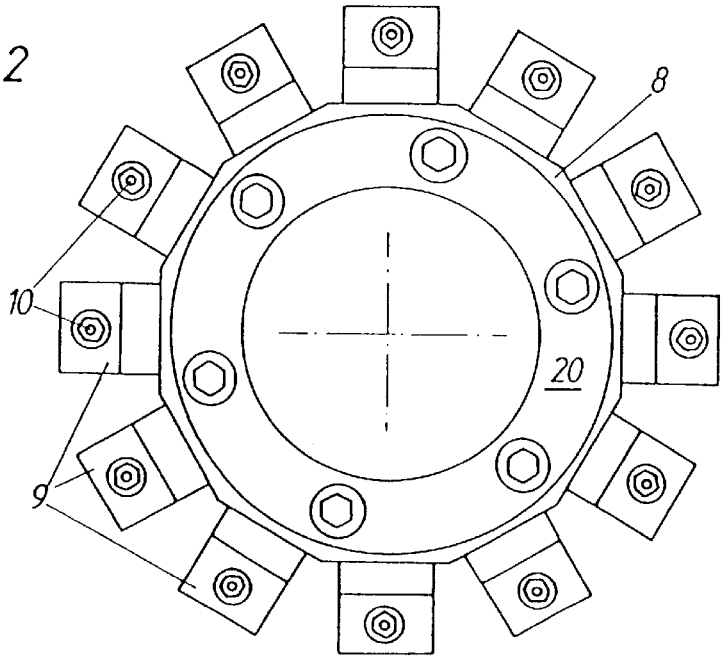
FIG. 2 displays a view of the rotor descaling device in the direction of arrow II, FIG. 3 displays a partial top view of the rotor hub according to line III—III of FIG. 1, FIG. 4 displays a top view of a plate cam according to arrow IV of FIG. 1, FIG. 5 displays a spray pattern on a rolled piece represented in top view.

In rotor descaling device 1, rotor 4, which is pivoted in gear housing 2 on rotational axis 3, is supported above bearing 6 with its rotor shaft 5. To rotor shaft 5, driving pinion 7 meshing with a rotor drive not represented in detail is mounted. At the end of rotor shaft 5 projecting outwards from gear housing 2 rotor hub 8 is located, which is provided with brackets 9 which radially extend outwards and which carry spray nozzles 10. According to the represented embodiment, twelve brackets 9 which are equally distributed along the circumference of rotor hub 8, are provided, one bracket 9 each being equipped with spray nozzle 10. Spray nozzles 10 are designed as circular-section jet nozzles and are connected with a line to port 11 which extends radially inwards from spray nozzle 10 through bracket 9 and rotor hub 8.

Rotor shaft 5 is of hollow design and interspersed by hollow tube 12, the so-called stator. This stator 12 projects from gear housing 2 with one end 13, with which is it connected to a fluid line 14, such as a high-pressure water line. Between stator 12 and rotor shaft 5 or rotor hub 8, through which stator 12 projects, liquid seals 15 are provided. At end 16 of stator 12 projecting outwards through rotor hub 8 plate cam 17 with control ports 18, 18', 18" is mounted, which is permanently connected with stator 12. Both plate cam 17 and stator 12 are covered with cover 20 tightly fixed to rotor 8, forming a liquid chamber 19 (high-pressure liquid chamber).

Figure 3:
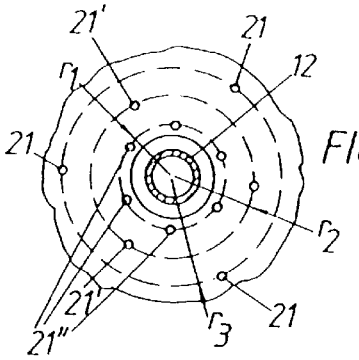
Figure 4:
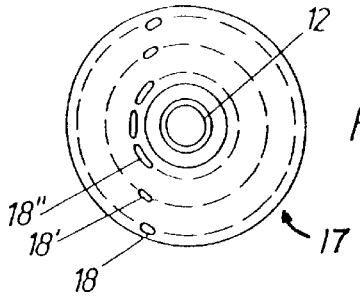

As can be particularly inferred from FIG. 4, control ports 18, 18', 18" of the plate cam are located at different radial distances $r_1$, $r_2$ and $r_3$ to rotational axis 3 of rotor shaft 5, radial distances $r_1$ to $r_3$ being selected in a way that control ports 18 to 18" can be aligned to mouths 21, 21', 21" of ports 11 shown in FIG. 3, which are located inside the rotor. This means that ports 11 also extend inwards up to different radial distances $r_1$ to $r_3$ from rotational axis 3 of rotor shaft 5.

According to plate cam 17 displayed in FIG. 4, several control ports 18, 18', 18" are provided at identical radial distances $r_1$ to $r_3$ of rotational axis 3 of rotor 4. These control ports may also be combined in groups, as shown in FIG. 4 for ports 18" which are provided at the shortest radial distance $r_1$ but may also be designed as bores only, so that at a rotation of rotor hub 8 on rotational axis 3, inside mouths 21 to 21" of ports 11 align only shortly with control ports 18, 18', 18" of plate cam 17, which is idle during rotation.

According to FIG. 4, control ports 18, 18', 18" are designed as slots so that mouths 21 to 21" of ports 11, which are located inside the rotation head, are aligned with control ports 18, 18', 18" over an extended rotational range.

Figure 5:
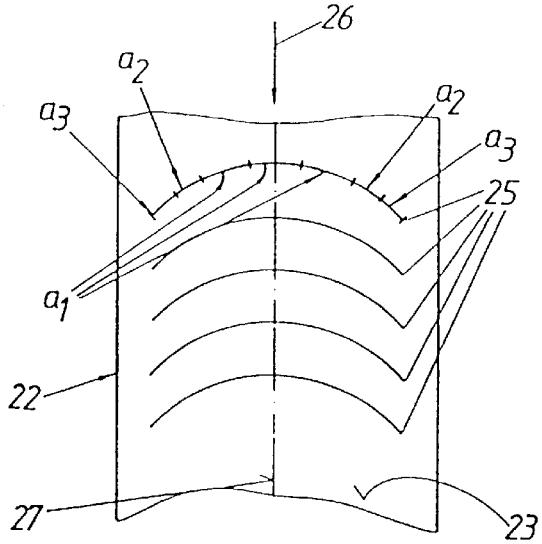

Rotor descaling device 1 has the following function:

While workpiece 22—according to FIG. 5, for example, a rolled plate and a plate yet to be rolled—with its surface 23 to be descaled is being moved on level 24 (cf. FIG. 6) past rotor descaling device 1, whose rotational axis 3 is approximately vertical to this level 24, liquid chamber 19 is pressurized with the liquid to be sprayed on workpiece surface 23 and rotor 4, i.e. rotor shaft 5 including rotor hub 8, is caused to rotate, whereby different ports 11 come into line contact with liquid chamber 19 by means of plate cam 17 so that one or several nozzles 10 are supplied with fluid and, consequently, liquid jets are formed.

The liquid jet is formed as long as control port 18, 18', 18" is linewise connected with the corresponding port 11. If this connection is interrupted, the liquid jet is also interrupted and does not form again until the next control port 18, 18', 18"—or the same control port after a rotation through 360°—is again linewise connected with port 11. As a result, an intermittent liquid jet is formed.

Plate cam 17, which is rigidly fixed to stator 12, thus forms an interrupting device which interrupts the liquid supply to one nozzle 10 each at intervals.

An appropriate arrangement of control ports 18, 18', 18" allows producing a spray pattern as shown, for example, in FIG. 5. Circular lines 25 illustrate the intermittent liquid jets striking workpiece surface 23 while the latter is being moved past rotor descaling device a in accordance with the feeding device represented by arrow 26.

When plate cam 17 according to FIG. 4 is used, the outermost section $a_3$ of circular line 25 is supplied by one nozzle 10 each, which are located at the largest radial distance $r_3$ from rotational axis 3 of rotor 4 through control slots 18.

Sections $a_2$ located adjacent to center line 27 of workpiece 22 are supplied by nozzles 10 through control ports 18' which are located at a mean distance $r_2$ from rotational axis 3, and the three central sections $a_1$ are formed at three closely adjoining control slots 18" which are located at the shortest distance $r_1$ from rotational axis 3 of rotor 4.

It is essential to provide stationary circular arc sections according to FIG. 5 $a_1$ to $a_3$ (at zero feed of the workpiece), i.e. the position of the sections from $a_1$ to $a_3$ is not changed in the direction of rotation because the plate cam is idle.

Figure 6:
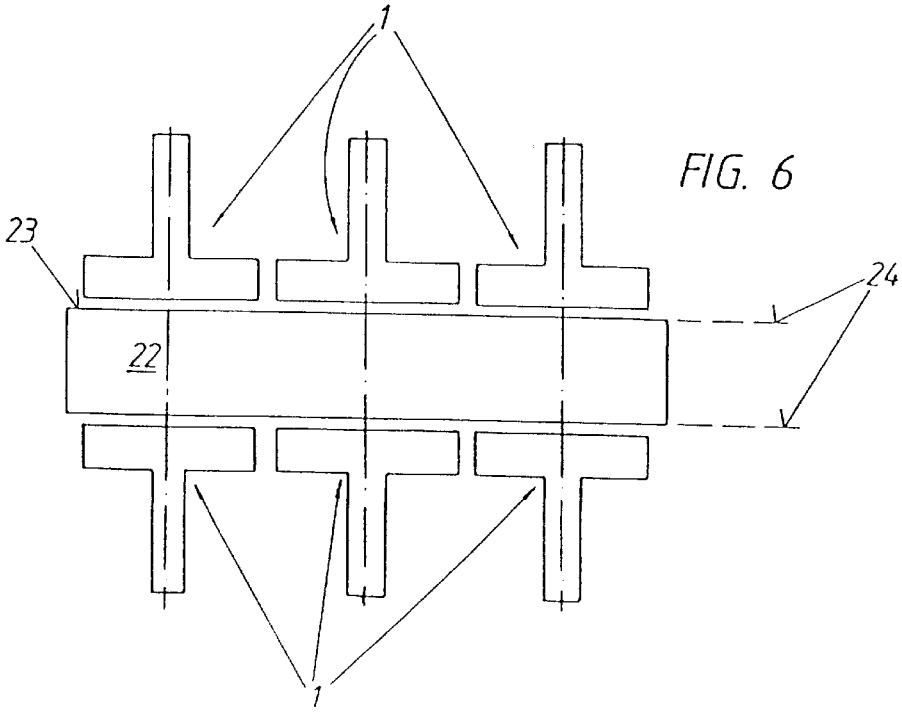
FIG. 6 illustrates the use of rotor descaling devices according to the invention for particularly wide workpieces, such as continuously cast slabs, etc.

FIG. 6 illustrates the arrangement of several rotor descaling devices 1 for large workpiece surfaces 23 as occurring, for example, with slabs or wide strips.

The invention is not limited to the embodiment shown in the drawing but can be modified in various aspects. For example, nozzles 10 can be located at different radial distances from rotational axis 3 of rotor 4, and control ports 18, 18', 18" can be arranged in a way that liquid can be fed to several nozzles 10 at the same time or to nozzles 10 individually one after another.

Groups of nozzles can have different nozzle diameters or can be comprised of different nozzle types. As a result, the water supply over the cross section of the workpiece to be descaled can be kept constant.

What is claimed is:

1. Process for descaling a workpiece (22), particularly a rolled piece, wherein the workpiece (22) is moved past a rotor descaling device (1), with a liquid supply line (14) to a stator (12) and to a rotor (4) which is rotated relative to the stator (12) and provided with at least one nozzle (10) for the formation of a liquid jet, where at least one temporary interrupted liquid jet rotating on a rotational axis (3) intersecting the surface (23) of the workpiece (22) to be descaled is sprayed onto the surface (23) to be descaled, characterized in that the liquid jet is formed intermittently in dependence on angular positions of the rotor (4), wherein between the rotor (4) and the stator (12) an interrupting device (17) is located, which allows intermittent supply of liquid to a nozzle (10).

2. Process according to claim 1, characterized in that several liquid jets are formed, with one liquid jet each being formed by means of a separate nozzle (10) and, during one rotation, allocated to a separate partial area ($a_1$, $a_2$, $a_3$) of the surface (23) of the workpiece (22) to be descaled.

3. Process according to claim 2, characterized in that the liquid jets are simultaneously formed.

4. Process according to claim 1, characterized in that the interrupting device is comprised of a plate cam (17) which is rigidly fixed compared with the stator (12) and provided with at least one control port (18, 18', 18") to allow liquid passage to the nozzle (10) that is limited in time.

5. Device according to claim 4, characterized in that the liquid supply line (14) leads into a liquid chamber (19) provided at the rotor (4), the rotor (4) is provided with a port (11) conveying the liquid to the nozzle (10), one mouth (21 to 21") of the port (11) leads into the liquid chamber (19), and the port (11) can be intermittently closed by means of the plate cam (17) and is cleared when the mouth (21) of the port (11) is in congruent position with the control port (18, 18', 18").

6. Process according to claim 5, characterized in that a plurality of ports (18, 18', 18") are provided and that each port (18, 18', 18") leads to one nozzle (10) of the rotor (4), with at least two mouths (21) of the ports (18, 18', 18") leading into the liquid chamber (19) at different radial distances ($r_1$, $r_2$, $r_3$) from the rotational axis (3) of the rotor (4) and the plate cam (17) is provided with a control port (18, 18', 18") corresponding to a mouth (21) of a port (11) and allowing liquid flow from the liquid chamber to the port.

7. Process according to claim 6, characterized in that several control ports (18, 18', 18") are provided at identical radial distances ($r_1$, $r_2$, $r_3$) from the rotational axis (3) of the rotor (4).

8. Process according to claim 7, characterized in that the control ports (18, 18', 18") located at identical radial distances ($r_1$, $r_2$, $r_3$) from the rotational axis (3) of the rotor (4) are combined in groups.

9. Process as claimed in claim 4, characterized in that one control port (18, 18', 18") is designed as a control slot extending in circumferential direction of the plate cam (17).

10. Process as claimed in claim 1, characterized in that the nozzles (10) are designed as circular-section jet nozzles.

* * * * *